US006413406B1

(12) United States Patent
de Nora

(10) Patent No.: US 6,413,406 B1
(45) Date of Patent: Jul. 2, 2002

(54) ELECTROCATALYTICALLY ACTIVE NON-CARBON METAL-BASED ANODES FOR ALUMINIUM PRODUCTION CELLS

(75) Inventor: Vittorio de Nora, Nassau (BS)

(73) Assignee: Moltech Invent S.A., Luxembourg ( * ) Notice: Subject to any disclaimer, the term of this patent is extended or adjusted under 35 U.S.C. 154(b) by 0 days.

(21) Appl. No.: 09/616,334

(22) Filed: Jul. 15, 2000

Related U.S. Application Data

(63) Continuation of application No. PCT/IB99/00080, filed on Jan. 19, 1999.

(51) Int. Cl.[7] ..... C25C 3/08

(52) U.S. Cl. ..... 205/384; 205/389; 205/392; 204/243.1; 204/247.3; 204/290.01

(58) Field of Search ..... 204/243.1, 247.3, 204/290.01; 205/372, 384, 389, 392

(56) References Cited

U.S. PATENT DOCUMENTS 6,077,415 A * 6/2000 Duruz et al. ..... 204/243.1

* cited by examiner

*Primary Examiner*—Bruce F. Bell
(74) *Attorney, Agent, or Firm*—Jayadeep E. Deshmnkh

(57) ABSTRACT

A non-carbon, metal-based high temperature resistant anode of a cell for the production of aluminum has a highly conductive metal-based substrate coated with one or more electrically conductive adherent intermediate protective layers and an outer layer which is electrically conductive and electrochemically active. The electrochemically active layer contains one or more electrocatalysts fostering the oxidation of oxygen ions as well as fostering the formation of biatomic molecular gaseous oxygen from the monoatomicnascent oxygen obtained by the oxidation of the oxygen ions present at the surface of the anode in order to inhibit ionic and/or monoatomic oxygen penetration. The intermediate layer(s) constitute(s) a substantially impermeable barrier to ionic, monoatomic and/or biatomic gaseous oxygen to prevent attack of the metal-based substrate. The electrocatalyst can be iridium, palladium, platinum, rhodium, ruthenium, silicon, tin, zinc, Mischmetal oxides and metals of the Lanthanide series. The applied layer usually comprises electrochemically active constituents selected from oxides, oxyfluorides, phosphides, carbides, in particular spinels such as ferrites.

21 Claims, No Drawings

ELECTROCATALYTICALLY ACTIVE NON-CARBON METAL-BASED ANODES FOR ALUMINIUM PRODUCTION CELLS

This application is a continuation of co-pending international application designating the USA, PCT/IB99/00080, filed on Jan. 19, 1999.

FIELD OF THE INVENTION

This invention relates to non-carbon metal-based anodes having an electrocatalytically active surface for use in cells for the electrowinning of aluminium by the electrolysis of alumina dissolved in a molten fluoride-containing electrolyte, as well as to electrowinning cells containing such anodes and their use to produce aluminium.

BACKGROUND ART

The technology for the production of aluminium by the electrolysis of alumina, dissolved in molten cryolite, at temperatures around 950° C. is more than one hundred years old.

This process, conceived almost simultaneously by Hall and Heroult, has not evolved as many other electrochemical processes.

The anodes are still made of carbonaceous material and must be replaced every few weeks. The operating temperature is still not less than 950° C. in order to have a sufficiently high solubility and rate of dissolution of alumina and high electrical conductivity of the bath.

The carbon anodes have a very short life because during electrolysis the oxygen which should evolve on the anode surface combines with the carbon to form polluting $CO_2$ and small amounts of CO and fluorine-containing dangerous gases. The actual consumption of the anode is as much as 450 Kg/Ton of aluminium produced which is more than ⅓ higher than the theoretical amount of 333 Kg/Ton.

The frequent substitution of the anodes in the cells is still a clumsy and unpleasant operation. This cannot be avoided or greatly improved due to the size and weight of the anode and the high temperature of operation.

Several improvements were made in order to increase the lifetime of the anodes of aluminium electrowinning cells, usually by improving their resistance to chemical attacks by the cell environment and air to those parts of the anodes which remain outside the bath. However, most attempts to increase the chemical resistance of anodes were coupled with a degradation of their electrical conductivity.

U.S. Pat. No. 4,614,569 (Duruz/Derivaz/Debely/Adorian) describes anodes for aluminium electrowinning coated with a protective coating of cerium oxyfluoride, formed in-situ in the cell or pre-applied, this coating being maintained by the addition of cerium compounds to the molten cryolite electrolyte. This made it possible to have a protection of the surface only from the electrolyte attack and to a certain extent from the gaseous oxygen but not from the nascent monoatomic oxygen.

EP Patent application 0 306 100 (Nyguen/Lazouni/Doan) describes anodes composed of a chromium, nickel, cobalt and/or iron based substrate covered with an oxygen barrier layer and a ceramic coating of nickel, copper and/or manganese oxide which may be further covered with an in-situ formed protective cerium oxyfluoride layer.

Likewise, U.S. Pat. Nos. 5,069,771, 4,960,494 and 4,956,068 (all Nyguen/Lazouni/Doan) disclose aluminium production anodes with an oxidised copper-nickel surface on an alloy substrate with a protective barrier layer. However, full protection of the alloy substrate was difficult to achieve.

U.S. Pat. No. 4,039,401 (Yamada/Hashimoto/Horinouchi) discloses anodes for the production of aluminium which are made of a metallic substrate coated with various electronic conductive oxide ceramics. However, protection of the substrate against corrosion is not addressed.

A significant improvement described in U.S. Pat. No. 5,510,008, and in International Application WO96/12833 (Sekhar/Liu/Duruz) involved a micropyretically produced body of nickel, aluminium, iron and copper whose surface is oxidised before use or in-situ. By said micropyretic methods materials have been obtained whose surfaces, when oxidised, are active for the anodic reaction and whose metallic interior has low electrical resistivity to carry a current from high electrical resistant surface to the busbars. However it would be useful, if it were possible, to simplify the manufacturing process of these materials and increase their life to make their use economic.

Metal or metal-based anodes are highly desirable in aluminium electrowinning cells instead of carbon-based anodes. Many attempts were made to use metallic anodes for aluminium production, however they were never adopted by the aluminium industry because of their poor performance.

OBJECTS OF THE INVENTION

An object of the invention is to reduce substantially the consumption of the electrochemically active anode surface of a non-carbon metal-based anode for aluminium electrowinning cells which is attacked by the nascent oxygen by enhancing the reaction of nascent oxygen to gaseous biatomic molecular gaseous oxygen.

Another object of the invention is to provide a coating for a non-carbon metal-based anode for aluminium electrowinning cells which has a high electrochemical activity and also a long life and which can easily be applied onto an anode substrate.

A further object of the invention is to provide a coating for a non-carbon metal-based anode for aluminium electrowinning cells which lowers the cell voltage compared to the voltage of cells having metal-based anodes which are not provided with this coating.

A major object of the invention is to provide an anode for the electrowinning of aluminium which has no carbon so as to eliminate carbon-generated pollution and reduce high cell operating costs.

SUMMARY OF THE INVENTION

The invention relates to a non-carbon, metal-based high temperature resistant anode of a cell for the production of aluminium by the electrolysis of alumina dissolved in a fluoride-containing electrolyte. The anode has a highly conductive metal-based substrate coated with one or more electrically conductive adherent intermediate protective layers and an outer layer which is electrically conductive and electrochemically active. The outer electrochemically active layer contains one or more electrocatalysts fostering the oxidation of oxygen ions as well as fostering the formation of biatomic molecular gaseous oxygen from the monoatomic nascent oxygen obtained by the oxidation of the oxygen ions present at the surface of the anode in order to inhibit ionic and/or monoatomic oxygen penetration. The intermediate layer(s) constitute(s) a substantially impermeable barrier to ionic, monoatomic and/or biatomic gaseous oxygen to prevent attack of the metal-based substrate.

In this context, metal-based substrate means that the anode substrate contains at least one metal as such or as alloys, intermetallics and/or cermets.

The electrocatalyst(s) may be selected from iridium, palladium, platinum, rhodium, ruthenium, silicon, tin or zinc metals, Mischmetal and their oxides and metals of the Lanthanide series and their oxides as well as mixtures and compounds thereof.

In addition to the electrocatalyst(s), the electrochemically active layer usually comprises mainly electrochemically active constituents selected from the group consisting of oxides, such as iron oxides, oxyfluorides, for instance cerium oxyfluoride, phosphides, carbides and combinations thereof.

An oxide may be present in the electrochemically active layer as such, or in a multi-compound mixed oxide and/or in a solid solution of oxides. The oxide may be in the form of a simple, double and/or multiple oxide, and/or in the form of a stoichiometric or non-stoichiometric oxide.

The electrochemically active layer may in particular comprise spinels and/or perovskites, such as ferrite which may be selected from cobalt, manganese, molybdenum, nickel, magnesium and zinc ferrite, and mixtures thereof. Nickel ferrite may be partially substituted with $Fe^{2+}$. Additionally, ferrites may doped with at least one oxide selected from the group consisting of chromium, titanium, tantalum, tin and zirconium oxide.

Optionally the electrochemically active layer may comprise a chromite, such as iron, cobalt, copper, manganese, beryllium, calcium, strontium, barium, magnesium, nickel and zinc chromite.

The electrochemically active layer may be applied in the form of powder or slurry onto metal-based substrate, dried as necessary and heat-treated.

Typically, the electrochemically active layer may advantageously be applied in the form a slurry or suspension containing colloidal material and then dried and/or heat treated. Such slurry or a suspension usually comprises at least one colloid selected from colloidal alumina, ceria, lithia, magnesia, silica, thoria, yttria, zirconia and colloids containing active constituents of the active filling. Ferrites and/or chromites may advantageously be applied with a catalyst onto the metal-based substrate in a slurry or suspension.

Different techniques may be used to apply the electrochemically active layer such as dipping, spraying, painting, brushing, calendar rolling, electroplating, plasma spraying, physical vapour deposition or chemical vapour deposition.

The metal-based substrate comprises a metal, an alloy, an intermetallic compound or a cermet. For instance, the metal-based substrate may comprise at least one metal selected from nickel, copper, cobalt, chromium, molybdenum, tantalum or iron. For instance, the core structure may be made of an alloy consisting of 10 to 30 weight % of chromium, 55 to 90% of at least one of nickel, cobalt or iron, and 0 to 15% of aluminium, titanium, zirconium, yttrium, hafnium or niobium.

Possibly, metal-based substrate may comprise an alloy or intermetallic compound containing at least two metals selected from nickel, iron and aluminium.

Alternatively, the metal-based substrate can comprise a cermet containing copper and/or nickel as a metal. The metal-based substrate may, in particular, comprise a cermet containing a metal and at least one stable oxide selected from nickel cuprate, nickel ferrite or nickel oxide.

In an embodiment, the anode substrate may be of the following composition and structure:

a) a metal-based core layer of low electrical resistance for connecting the anode to a positive current supply, such as a metal, an alloy, an intermetallic compound and/or a cermet, for instance nickel-plated copper;

b) at least one intermediate layer on the metal-based core layer forming a barrier substantially impervious to monoatomic and molecular oxygen, such as chromium oxide and/or black non-stoichiometric nickel oxide, chromium or nickel-chromium alloys; and c) one or more intermediate protective layers on the oxygen barrier to protect the oxygen barrier and which remain inactive in the reactions for the evolution of oxygen gas but inhibits the dissolution of the oxygen barrier, such as nickel and/or copper as metals and/or oxides;

the intermediate protective layer(s) being coated with the electrically conductive, electrochemically active adherent applied layer comprising the electrocatalyst according to the invention.

The invention also relates to a cell for the production of aluminium by the electrolysis of alumina dissolved in a molten electrolyte comprising at least one anode as described above.

Advantageously, the cell may comprise at least one aluminium-wettable cathode which can be a drained cathode on which aluminium is produced and from which it continuously drains.

Usually, the cell is in a monopolar, multi-monopolar or in a bipolar configuration. Bipolar cells may comprise the anodes as described above as the anodic side of at least one bipolar electrode and/or as a terminal anode.

In such a bipolar cell an electric current is passed from the surface of the terminal cathode to the surface of the terminal anode as ionic current in the electrolyte and as electronic current through the bipolar electrodes, thereby electrolysing the alumina dissolved in the electrolyte to produce aluminium on each cathode surface and oxygen on each anode surface.

Preferably, the cell comprises means to improve the circulation of the electrolyte between the anodes and facing cathodes and/or means to facilitate dissolution of alumina in the electrolyte. Such means can for instance be provided by the geometry of the cell as described in co-pending application PCT/IB98/00161 (de Nora/Duruz) or by periodically moving the anodes as described in co-pending application PCT/IB98/00162 (Duruz/Bellò).

The cell may be operated with the electrolyte at conventional temperatures, such as 950 to 970° C., or at reduced temperatures as low as 750° C.

Another aspect of the invention is a method of producing aluminium in such a cell, wherein alumina is dissolved in the electrolyte and then electrolysed to produce aluminium.

Advantageously, during electrolysis the anodes are protected with a protective coating of cerium oxyfluoride on the electrochemically active layer. Usually, the protective coating is formed in-situ in the cell or pre-applied, and maintained by the addition of small amounts of cerium compounds to the electrolyte as described in U.S. Pat. No. 4,614,569 (Duruz/Derivaz/Debely/Adorian).

Alternatively, one or more constituents of the electrochemically active layer may be added to the electrolyte in an amount to slow down dissolution of the electrochemically active layer.

DETAILED DESCRIPTION

The invention will be further described in the following Examples:

EXAMPLE 1

A test anode was made by applying on a copper substrate an electrochemically active coating containing an electrocatalyst in the form of iridium oxide for the rapid conversion of the monoatomic oxygen formed into biatomic molecular gaseous oxygen.

A 100 micron thick intermediate layer of a nickel-chromium alloy was directly applied on the copper substrate by arc spraying.

A slurry was prepared by mixing an amount of 1 g of commercially available nickel ferrite powder with 0.75 ml of an inorganic polymer containing 0.25 g nickel-ferrite per 1 ml of water. An amount corresponding to 5 weight % of $IrO_2$ in the form of $IrCl_4$ was then added to the slurry.

The slurry was then brush-coated onto the nickel substrate by applying 3 successive layers of the slurry each layer being approximately 50 micron thick. Each slurry-applied layer was dried by heat-treating at 500° C. for 15 minutes between each layer application.

The anode was then tested in molten cryolite containing approximately 6 weight % alumina at 970° C. at a current density of about 0.8 A/cm$^2$. The anode was extracted from the cryolite after 100 hours and showed no sign of significant internal corrosion after microscopic examination of a cross-section of the anode specimen. Furthermore, during electrolysis the cell voltage was about 110 mV lower than the measured cell voltage of similarly prepared anodes having no electrocatalyst.

EXAMPLE 2

A test anode was made by coating by electro-deposition a core structure in the shape of a copper rod having a diameter of 12 mm a chromium-iron-nickel intermediate layer about 200 micron thick by arc spraying.

The coated structure was heat treated at 1000° C. in argon for 5 hours. This heat treatment provides for the interdiffusion of nickel and copper to form an intermediate layer. The structure was then heat treated for 24 hours at 10000 in air to form a chromium oxide ($Cr_2O_3$) barrier layer on the core structure and oxidising at least partly the interdiffused nickel-copper layer thereby forming the intermediate layer.

A slurry was prepared by mixing an amount of 1 g of commercially available nickel ferrite powder with 0.75 ml of an inorganic polymer containing 0.25 g nickel-ferrite per 1 ml of water. An amount corresponding to 5 weight % of $IrO_2$ acting as an electrocatalyst for the rapid conversion of oxygen ions into monoatomic oxygen and subsequently gaseous oxygen, was then added to the slurry as $IrCl_4$.

The slurry was then brush-coated onto the interdiffused nickel copper layer by applying 3 successive 50 micron thick layers of the slurry, each slurry-applied layer having been allowed to dry by heat-treating the anode at 500° C. for 15 minutes between each layer application.

The anode was then tested in molten cryolite at 970° C. containing approximately 6 weight % alumina, by passing a current at a current density of about 0.8 A/cm$^2$. The anode was extracted from the cryolite after 100 hours and showed no sign of significant internal corrosion after microscopic examination of a cross-section of the anode specimen.

As for the anode described in Example 1, the cell voltage was about 120 mV lower than the measured cell voltage of similarly prepared anodes having no electrocatalyst.

What is claimed is:

1. A non-carbon, metal-based high temperature resistant anode of a cell for the production of aluminium by the electrolysis of alumina dissolved in a fluoride-containing electrolyte, having a highly conductive metal-based substrate coated with one or more electrically conductive adherent intermediate protective layers and an outer layer which is electrically conductive and electrochemically active, said electrochemically active layer containing iridium and/or iridium oxide as an electrocatalyst to foster the oxidation of oxygen ions as well as fostering the formation of biatomic molecular gaseous oxygen from the monoatomic nascent oxygen obtained by the oxidation of the oxygen ions present at the surface of the anode in order to inhibit ionic and/or monoatomic oxygen penetration, the intermediate layer(s) constituting a substantially impermeable barrier to ionic, monoatomic and/or biatomic gaseous oxygen to prevent attack of the metal-based substrate.

2. The anode of claim 1, wherein the electrochemically active layer contains at least one further electrocatalyst selected from palladium, platinum, rhodium, ruthenium, silicon, tin or zinc metals, Mischmetal and their oxides and metals of the Lanthanide series and their oxides as well as mixtures and compounds thereof.

3. The anode of claim 1, wherein the electrochemically active layer contains in addition to the electrocatalyst mainly an electrochemically active constituent selected from the group consisting of oxides, oxyfluorides, phosphides, carbides and combinations thereof.

4. The anode of claim 3, wherein the electrochemically active constituents comprise iron oxide and/or cerium oxyfluoride.

5. The anode of claim 3, wherein electrochemically active constituents comprise at least one ferrite.

6. The anode of claim 5, wherein electrochemically active constituents comprise at least one ferrite selected from cobalt, manganese, molybdenum, nickel, magnesium and zinc ferrite, and mixtures thereof.

7. The anode of claim 6, wherein the ferrite is doped with at least one oxide selected from the group consisting of chromium, titanium, tantalum, tin and zirconium oxide.

8. The anode of claim 6, wherein the ferrite is nickel-ferrite or nickel ferrite partially substituted with $Fe^{2+}$.

9. The anode of claim 3, wherein the electrochemically active constituents comprise at least one chromite.

10. The anode of claim 9, wherein the electrochemically active constituents comprise at least one chromite selected from iron, cobalt, copper, manganese, beryllium, calcium, strontium, barium, magnesium, nickel and zinc chromite.

11. The anode of claim 1, wherein the oxygen barrier layer is made of chromium oxide and/or black non-stoichiometric nickel oxide, chromium or a nickel-chromium alloy.

12. The anode of claim 1, wherein the oxygen barrier is covered with a protective layer made of at least one of nickel and copper.

13. The anode of claim 1, wherein the metal-based substrate comprises a metal, an alloy, an intermetallic compound and/or a cermet.

14. A cell for the production of aluminium by the electrolysis of alumina dissolved in a molten fluoride-containing electrolyte comprising at least one anode according to claim 1.

15. The cell of claim 14, comprising at least one aluminium-wettable cathode.

16. The cell of claim 15, comprising at least one drained cathode.

17. The cell of claim 16, which is in a bipolar configuration, and wherein the anodes form the anodic side of at least one bipolar electrode and/or of a terminal anode.

18. The cell of claim 14, comprising means to improve the circulation of the electrolyte between the anodes and facing cathodes and/or means to facilitate dissolution of alumina in the electrolyte.

19. The cell of claim 14, wherein during operation the electrolyte is at a temperature of 750° C. to 970° C.

20. A method of producing aluminium in an aluminium electrowinning cell according to claim 14, wherein alumina is dissolved in the electrolyte and then electrolysed to produce aluminium.

21. The method of claim 20, wherein during electrolysis the or each anode is protected with a protective coating of cerium oxyfluoride on the electrochemically active layer, the protective coating being formed in-situ in the cell or pre-applied, and maintained by the addition of small amounts of cerium to the electrolyte.

* * * * *